US006383461B1

(12) United States Patent
Lang

(10) Patent No.: US 6,383,461 B1
(45) Date of Patent: May 7, 2002

(54) FUEL DILUTION METHODS AND APPARATUS FOR $NO_X$ REDUCTION

(75) Inventor: Jerry M. Lang, Lindale, TX (US)

(73) Assignee: John Zink Company, LLC, Tulsa, OK (US)

( * ) Notice: Subject to any disclaimer, the term of this patent is extended or adjusted under 35 U.S.C. 154(b) by 0 days.

(21) Appl. No.: 09/547,769

(22) Filed: Apr. 12, 2000

Related U.S. Application Data

(60) Provisional application No. 60/161,536, filed on Oct. 26, 1999.

(51) Int. Cl.[7] ..... B01D 53/54; B01D 53/60

(52) U.S. Cl. ..... 423/235; 110/345; 422/183; 423/210

(58) Field of Search ..... 110/204, 205, 110/345; 423/210, 235; 431/5, 12, 116; 422/182, 183, 234

(56) References Cited

U.S. PATENT DOCUMENTS

| | | | | |
|---|---|---|---|---|
| 3,831,582 | A | 8/1974 | Mahoney et al. | 126/286 |
| 4,277,942 | A | 7/1981 | Egnell et al. | 60/517 |
| 4,309,965 | A | 1/1982 | Hill | 122/15 |
| 4,335,660 | A | 6/1982 | Maloney et al. | 110/206 |
| 4,338,888 | A | 7/1982 | Gerstmann et al. | 122/16 |
| 4,366,805 | A | 1/1983 | Hill | 126/285 R |
| 4,439,135 | A | 3/1984 | Altemark et al. | 431/2 |
| 4,445,464 | A | 5/1984 | Gerstmann et al. | 122/16 |
| 4,494,485 | A | 1/1985 | Kendall et al. | 122/250 R |
| 4,501,127 | A | 2/1985 | Sommers et al. | 62/238.3 |
| 4,530,656 | A | 7/1985 | Altemark et al. | 431/8 |
| 4,582,476 | A | 4/1986 | Altemark et al. | 431/8 |
| 4,629,413 | A | 12/1986 | Michelson et al. | 431/9 |
| 4,671,250 | A | 6/1987 | Hurley et al. | 126/21 A |
| 4,679,528 | A | 7/1987 | Krans et al. | 122/367 C |
| 4,699,071 | A | 10/1987 | Vier et al. | 110/345 |
| 4,719,899 | A | 1/1988 | Burkhart | 126/163 R |
| 4,852,504 | A | 8/1989 | Barresi et al. | 110/346 |
| 4,861,263 | A | 8/1989 | Schirmer | 431/158 |
| 4,886,519 | A | 12/1989 | Hayes et al. | 44/51 |
| 4,909,731 | A | 3/1990 | Zinn et al. | 432/58 |
| 4,995,807 | A * | 2/1991 | Rampley et al. | 431/9 |
| 5,027,723 | A | 7/1991 | Landreth et al. | 110/343 |
| 5,043,150 | A | 8/1991 | Hiltunen et al. | 423/239 |
| 5,044,931 | A | 9/1991 | Van Eerden et al. | 431/8 |
| 5,044,932 | A | 9/1991 | Martin et al. | 431/116 |
| 5,055,030 | A | 10/1991 | Schirmer | 431/10 |
| 5,078,064 | A | 1/1992 | Breen et al. | 10/212 |
| 5,092,761 | A | 3/1992 | Dinicolantonio | 431/115 |
| 5,098,282 | A | 3/1992 | Schwartz et al. | 431/9 |
| 5,109,806 | A | 5/1992 | Duggan et al. | 122/13.1 |
| 5,133,950 | A | 7/1992 | Oakes et al. | 423/239 |
| 5,147,200 | A | 9/1992 | Knöpfel et al. | 431/11 |
| 5,154,596 | A | 10/1992 | Schwartz et al. | 431/9 |
| 5,199,384 | A | 4/1993 | Kayahara et al. | 122/18 |
| 5,199,385 | A | 4/1993 | Doss | 122/504 |
| 5,201,650 | A | 4/1993 | Johnson | 431/9 |

(List continued on next page.)

*Primary Examiner*—Steven P. Griffin
*Assistant Examiner*—Maribel Medina
(74) *Attorney, Agent, or Firm*—McAfee & Taft; C. Clark Dougherty, Jr.

(57) ABSTRACT

Methods and apparatus for reducing the content of nitrogen oxides in the flue gases produced by the combustion of fuel gas and combustion air introduced into a burner connected to a furnace are provided. The methods basically comprise the steps of conducting the combustion air to the burner, providing a chamber outside of the burner and furnace for mixing flue gases from the furnace with the fuel gas, discharging the fuel gas in the form of a fuel jet into the mixing chamber so that flue gases from the furnace are drawn into the chamber and mixed with and dilute the fuel gas therein and conducting the resulting mixture of flue gases and fuel gas to the burner wherein the mixture is combined with the combustion air and burned in the furnace.

21 Claims, 5 Drawing Sheets

U.S. PATENT DOCUMENTS 5,203,689 A 4/1993 Duggan et al. ..... 431/114
5,240,409 A 8/1993 Xiong ..... 431/189
5,246,364 A 9/1993 Landreth et al. ..... 431/3
5,269,678 A 12/1993 Schwartz et al. ..... 431/9
5,292,244 A 3/1994 Xiong ..... 431/189
5,316,469 A 5/1994 Martin et al. ..... 431/116
5,344,307 A 9/1994 Schwartz et al. ..... 431/9
5,402,713 A 4/1995 King ..... 99/408
5,407,347 A 4/1995 Bortz ..... 431/183
5,437,249 A 8/1995 Adams et al. ..... 122/17
5,460,512 A 10/1995 Lifshits et al. ..... 431/9
5,470,224 A 11/1995 Bortz ..... 431/182
5,603,906 A * 2/1997 Lang et al. ..... 422/182
5,617,776 A 4/1997 King et al. ..... 99/408
5,636,977 A 6/1997 Benson et al. ..... 431/8
5,667,374 A 9/1997 Nutcher et al. ..... 431/7
5,697,330 A 12/1997 Yetman et al. ..... 122/13.1
5,727,938 A 3/1998 Knöpfel ..... 431/285

* cited by examiner

FUEL DILUTION METHODS AND APPARATUS FOR $NO_X$ REDUCTION

CROSS-REFERENCE TO RELATED APPLICATION

This application claims the benefit of U.S. Provisional Patent Application No. 60/161,536 filed on Oct. 26, 1999.

BACKGROUND OF THE INVENTION

1. Field of the Invention

The present invention relates to fuel dilution methods and apparatus for reducing the production of nitrogen oxides during the combustion of fuel gas and combustion air.

2. Description of the Prior Art

Nitrogen oxides ($NO_x$) are produced during the combustion of fuel-air mixtures at high temperatures. An initial, relatively rapid reaction between nitrogen and oxygen occurs predominantly in the combustion zone to produce nitric oxide in accordance with the reaction $N_2+O_2 \rightarrow 2NO$. The nitric oxide (also referred to as "prompt $NO_x$") is further oxidized outside the combustion zone to produce nitrous oxide in accordance with the reaction $2NO+O_2 \rightarrow 2NO_2$.

Nitrogen oxide emissions are associated with a number of environmental problems including smog formation, acid rain and the like. As a result of the adoption of stringent environmental emission standards by government authorities and agencies, methods and apparatus to suppress the formation of nitrogen oxides in flue gases produced by the combustion of fuel-air mixtures have been developed and used heretofore. For example, methods and apparatus wherein fuel is burned in less than a stoichiometric concentration of oxygen to intentionally produce a reducing environment of CO and $H_2$ have been proposed. This concept has been utilized in staged air burner apparatus wherein the fuel is burned in a deficiency of air in a first zone producing a reducing environment that suppresses $NO_x$ formation, and then the remaining portion of air is introduced into a second zone.

Other methods and apparatus have been developed wherein flue gases are combined with fuel or fuel-air mixtures in burner structures to thereby dilute the mixtures and lower their combustion temperatures and the formation of $NO_x$. In another approach, flue gases have been recirculated and mixed with the combustion air supplied to the burner upstream of the burner.

While the above described techniques for reducing $NO_x$ emissions with flue gas have been effective in reducing $NO_x$ formation and flue gas $NO_x$ content, there are certain disadvantages and drawbacks associated with them. For example, in converting existing furnaces (including boilers) to flue gas recirculation, the modification or replacement of the existing burner or burners and/or combustion air blowers and related apparatus is often required. The modifications often result in increased flame spread and other combustion zone changes which require internal alterations to the furnaces in which modified burners are installed. The changes and modifications required often involve substantial capital expenditures, and the modified furnaces and burners are often more difficult and costly to operate and maintain than those they replaced.

Thus, there are continuing needs for improved methods and apparatus for reducing $NO_x$ formation and emissions in and from existing furnaces without the substantial modifications and expenditures which have heretofore been required.

SUMMARY OF THE INVENTION

The present invention provides methods and apparatus which meet the needs described above and overcome the deficiencies of the prior art. The methods of the present invention for reducing the content of nitrogen oxides in the flue gases produced by the combustion of an at least substantially stoichiometric mixture of fuel gas and combustion air introduced into a burner connected to a furnace are basically comprised of the following steps. The combustion air is conducted to the burner, and a chamber is provided outside of the burner and furnace for mixing flue gases from the furnace with the fuel gas. The fuel gas is discharged in the form of a fuel jet into the mixing chamber so that flue gases from the furnace are drawn into the chamber and mixed with and dilute the fuel gas therein. The flue gases-fuel gas mixture formed in the mixing chamber is conducted to the burner wherein the mixture is combined with the combustion air and burned in the furnace.

The apparatus of this invention can be integrated into an existing burner-furnace system without substantially modifying or replacing existing burners, air blowers and the like and reduces the content of nitrogen oxides in the flue gases produced by the combustion of fuel gas and combustion air in the furnace. At most, the burners may require minor modifications to accommodate the increased mass and reduced pressure of the flue gases-fuel gas mixture, e.g., the replacement of the burner tips.

The apparatus is basically comprised of a mixing chamber which is separate from the burner and furnace for mixing flue gases from the furnace with the fuel gas prior to when the fuel gas is conducted to the burner. The mixing chamber includes a fuel gas inlet for connection to a fuel gas conduit and for forming a fuel jet within the chamber, a flue gases inlet positioned so that flue gases are drawn into the chamber by the fuel jet and a flue gases-fuel gas mixture outlet. A flue gases conduit for connection to the furnace is connected to the flue gases inlet of the chamber, and a flue gases-fuel gas mixture conduit for connection to the burner is connected to the flue gases-fuel gas mixture outlet of the chamber.

It is, therefore, a general object of the present invention to provide fuel dilution methods and apparatus for $NO_x$ reduction.

Other and further objects, features and advantages of the invention will be readily apparent to those skilled in the art upon a reading of the description of preferred embodiments which follows when taken in conjunction with the accompanying drawings.

BRIEF DESCRIPTION OF THE DRAWINGS

FIG. 6 is a schematic illustration which is the same as FIG. 3 except that it includes both a steam inlet conduit connected to the first flue gases conduit and a second flue gases conduit connected between the furnace and the air blower.

DESCRIPTION OF PREFERRED EMBODIMENTS

The present invention provides methods and apparatus for reducing the content of nitrogen oxides in the flue gases produced by the combustion of fuel gas and combustion air introduced into a burner connected to a furnace. The apparatus of this invention can be added to a furnace having one or more burners connected thereto or to a plurality of such furnaces without replacing existing combustion air fans or blowers and without modifying or replacing the existing burners. The apparatus is simple and can be readily installed which reduces furnace down time and installation costs. More importantly, the methods and apparatus of this invention are more effective in reducing $NO_x$ production than prior methods and apparatus and are more efficient in operation.

The methods and apparatus utilize recirculated flue gases which are thoroughly mixed and blended with the fuel gas thereby diluting the fuel gas well before it is introduced into one or more burners connected to a furnace. The flue gases diluted fuel gas is mixed with combustion air in the burner and combusted therein and in the furnace at a lower flame temperature and more uniform combustion is achieved. Both of these factors contribute to reduce the formation of prompt $NO_x$ which is generally not achieved to the same degree by the prior art.

Figure 1:
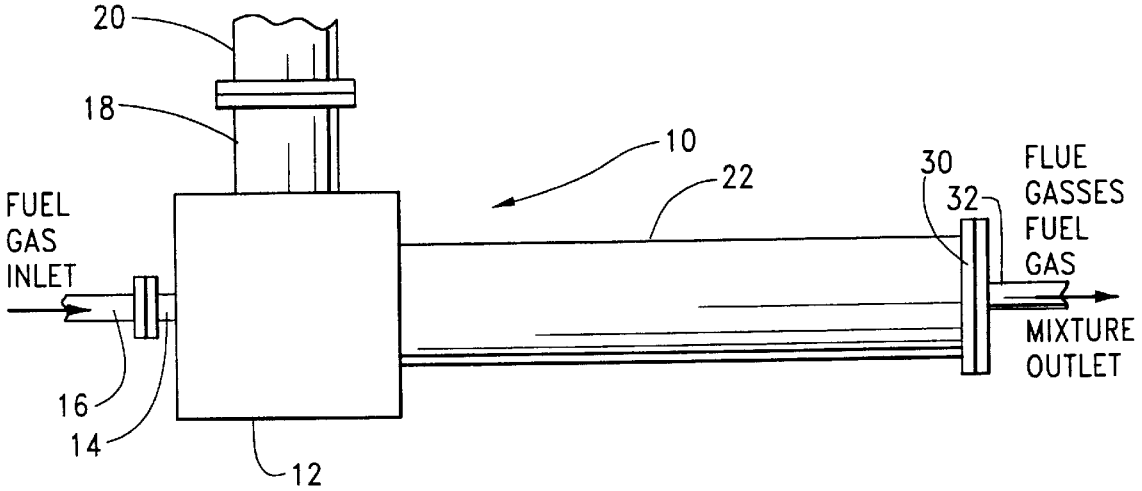
FIG. 1 is a side elevational view of the flue gases-fuel gas mixing chamber of the present invention.
Figure 2:
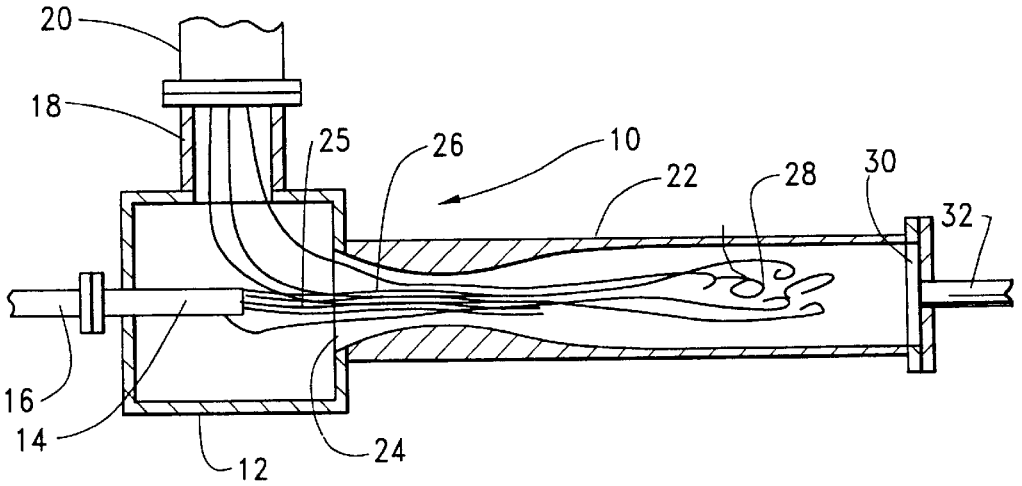
FIG. 2 is a side cross-sectional view of the mixing chamber of FIG. 1.

Referring now to the drawings, and particularly to FIGS. 1 and 2, the mixing chamber apparatus of the present invention is illustrated and designated by the numeral 10. The mixing chamber 10 includes a gas receiving compartment 12 having a fuel gas inlet connection 14 for connection to a fuel gas conduit 16 and a flue gases inlet connection 18 for connection to a flue gases conduit 20. The mixing chamber also includes a venturi and mixing compartment 22 sealingly attached over an opening 24 in the gas receiving compartment 12 opposite the fuel gas inlet connection 14. As shown in FIG. 2, the fuel gas inlet connection 14 includes a nozzle portion which extends into the gas receiving compartment 12 so that a fuel jet 25 is formed therein which extends into and through the venturi section 26 of the venturi and mixing compartment 22. As is well understood by those skilled in the art, the flow of the fuel jet 25 through the venturi section 26 creates a pressure drop in the gas receiving compartment 12 which causes flue gases to be drawn through the flue gases conduit 20 into the gas receiving chamber 12, through the venturi section 26 of the venturi and mixing compartment 22 and into the downstream mixing section 28 thereof. The flue gases drawn into the mixing chamber 10 are thoroughly mixed with the fuel gas therein and are discharged from the mixing chamber 10 by way of a flue gases-fuel gas mixture outlet connection 30 to which a flue gases-fuel gas mixture conduit 32 is connected.

Figure 3:
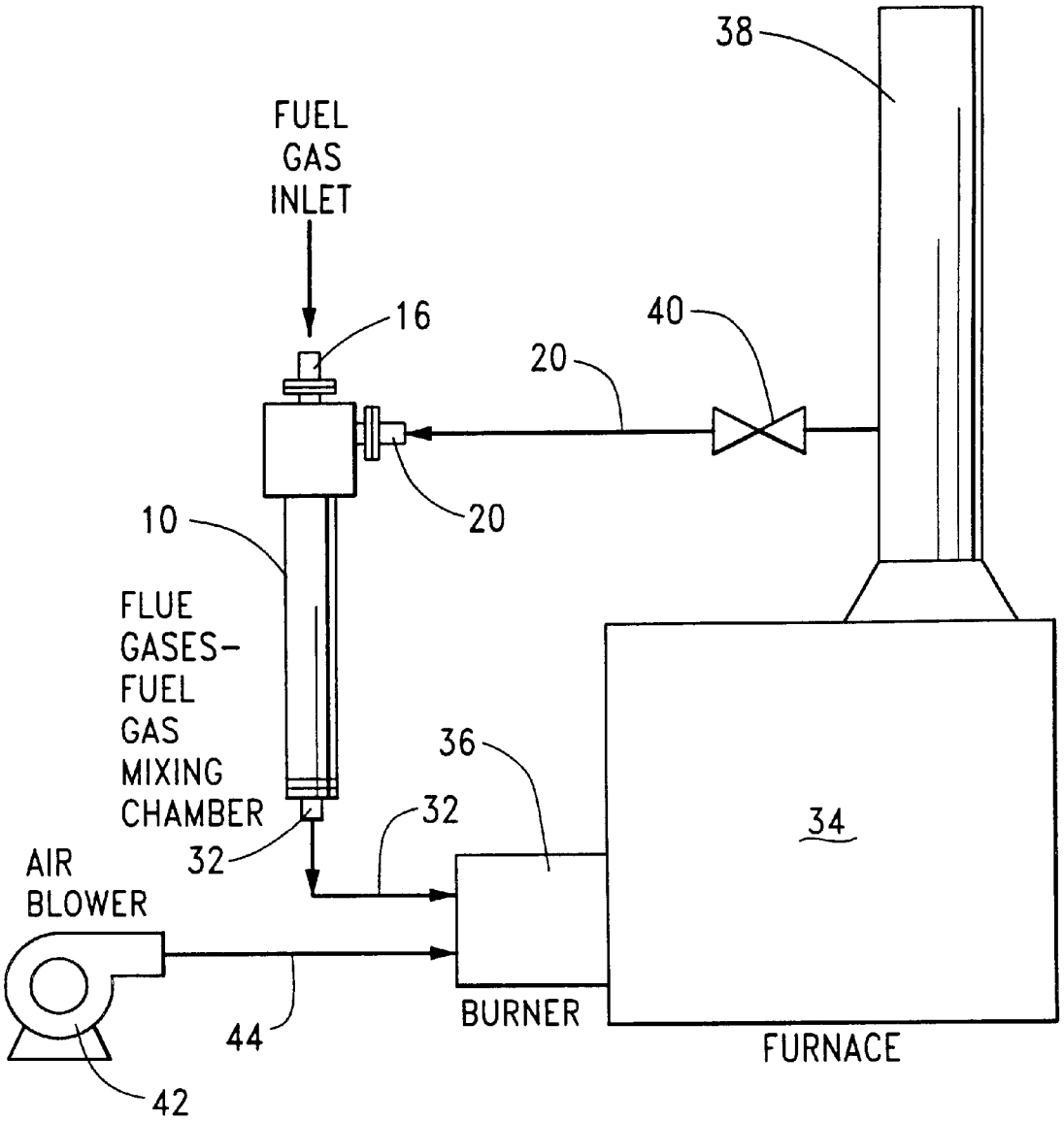
FIG. 3 is a schematic illustration of the apparatus of the present invention connected to a conventional burner and furnace.

Referring now to FIG. 3, the mixing chamber 10 is schematically illustrated operably connected to a furnace 34 having a burner 36 connected thereto. As shown in FIG. 3, the mixing chamber 10 is connected to the fuel gas inlet conduit 16 the other end of which is connected to a source of pressurized fuel gas, to the flue gases conduit 20 the other end of which is connected to the furnace 34 (more particularly to the flue gases stack 38 thereof) and to the flue gases-fuel gas mixture conduit 32 the other end of which is connected to the fuel gas inlet connection of the burner 36. A flow control valve 40 is disposed in the flue gases conduit 20 for controlling the volume ratio of flue gases mixed with fuel gas in the mixing chamber 10. A source of combustion air, e.g., a combustion air blower 42, is connected to a combustion air conduit 44 the other end of which is connected to the burner 36.

In operation of the apparatus illustrated in FIG. 3, combustion air produced by the combustion air blower 42 is conducted by the conduit 44 to the burner 36. Pressurized fuel gas is conducted by the conduit 16 to the mixing chamber 10. The amounts of fuel gas and combustion air are controlled by conventional flow control valves and controls or other similar apparatus (not shown) so that at least a substantially stoichiometric mixture of fuel gas and combustion air is introduced into the burner 36.

As described above, the pressurized fuel gas forms a fuel jet in the mixing chamber 10 so that flue gases from the furnace are drawn into the mixing chamber 10 and are mixed with and dilute the fuel gas therein. The resulting mixture of flue gases and fuel gas formed in the mixing chamber 10 is conducted to the burner 36 by the conduit 32. The combustion air conducted to the burner 36 by the conduit 44 and the flue gases-fuel gas mixture conducted thereto by the conduit 32 are mixed within the burner 36. The resulting mixture of flue gases, fuel gas and combustion air is combusted in the burner 36 and the furnace 34 and flue gases are formed. The flue gases are released to the atmosphere by way of the stack 38. A portion of the flue gases flowing through the stack 38 is continuously withdrawn therefrom by way of the conduit 20 connected thereto and is caused to flow into the mixing chamber 10 as described above. The flow control valve 40 is utilized to control the volume ratio of the flue gases mixed with the fuel gas in the mixture chamber 10 so that the maximum reduction of nitrogen oxides in the flue gases produced and vented to the atmosphere by way of the stack 38 is achieved.

Figure 4:
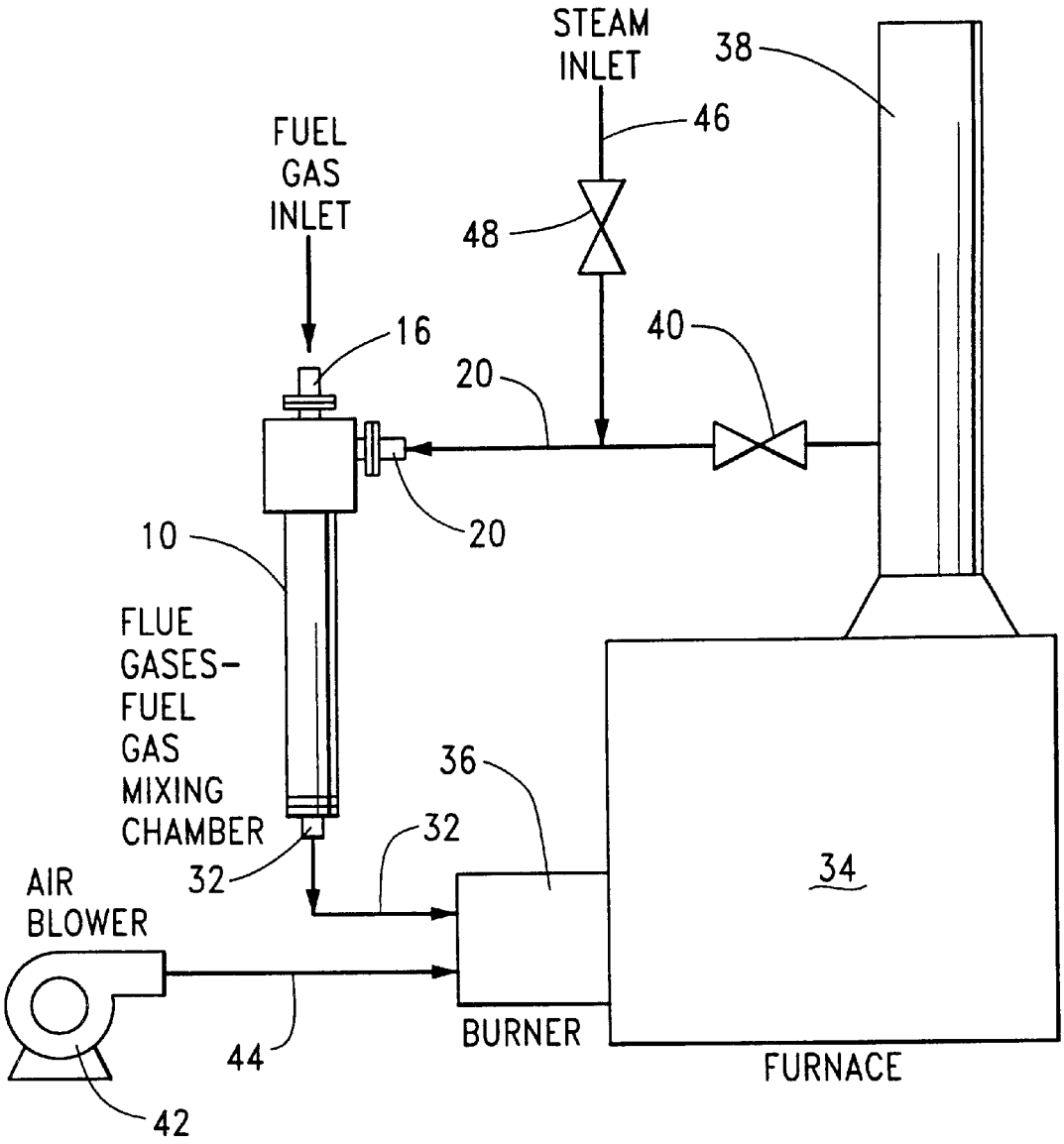
FIG. 4 is a schematic illustration whis is the same as FIG. 3 except the steam inlet is connected between the flue gas inlet and the flow control valve.

Referring now to FIG. 4, the schematic illustration of the mixing chamber 10, the combustion air blower 42, the burner 36 and furnace 34 is shown utilizing the same reference numerals as in FIG. 3. In addition, FIG. 4 includes a steam inlet conduit 46 attached to the flue gases conduit 20 at a point between the flow control valve 40 and the mixing chamber 10. The steam conduit 46 includes a flow control valve 48 disposed therein for controlling the volume ratio of steam mixed with the flue gases in the conduit 20.

The operation of the apparatus illustrated in FIG. 4 is identical to the operation described above for the apparatus illustrated in FIG. 3 except that steam is mixed with the flue gases and the mixture of steam and flue gases is drawn into the mixing chamber 10 wherein it is mixed with fuel gas. The resulting mixture of steam, flue gases and fuel gas is conducted to the burner 36 wherein combustion air is mixed therewith and the resulting mixture of steam, flue gases, fuel gas and combustion air is combusted in the burner 36 and furnace 34. The presence of the steam in the combusted mixture further dilutes the fuel, reduces the flame temperature and reduces the content of nitrogen oxides in the flue gases discharged into the atmosphere.

Figure 5:
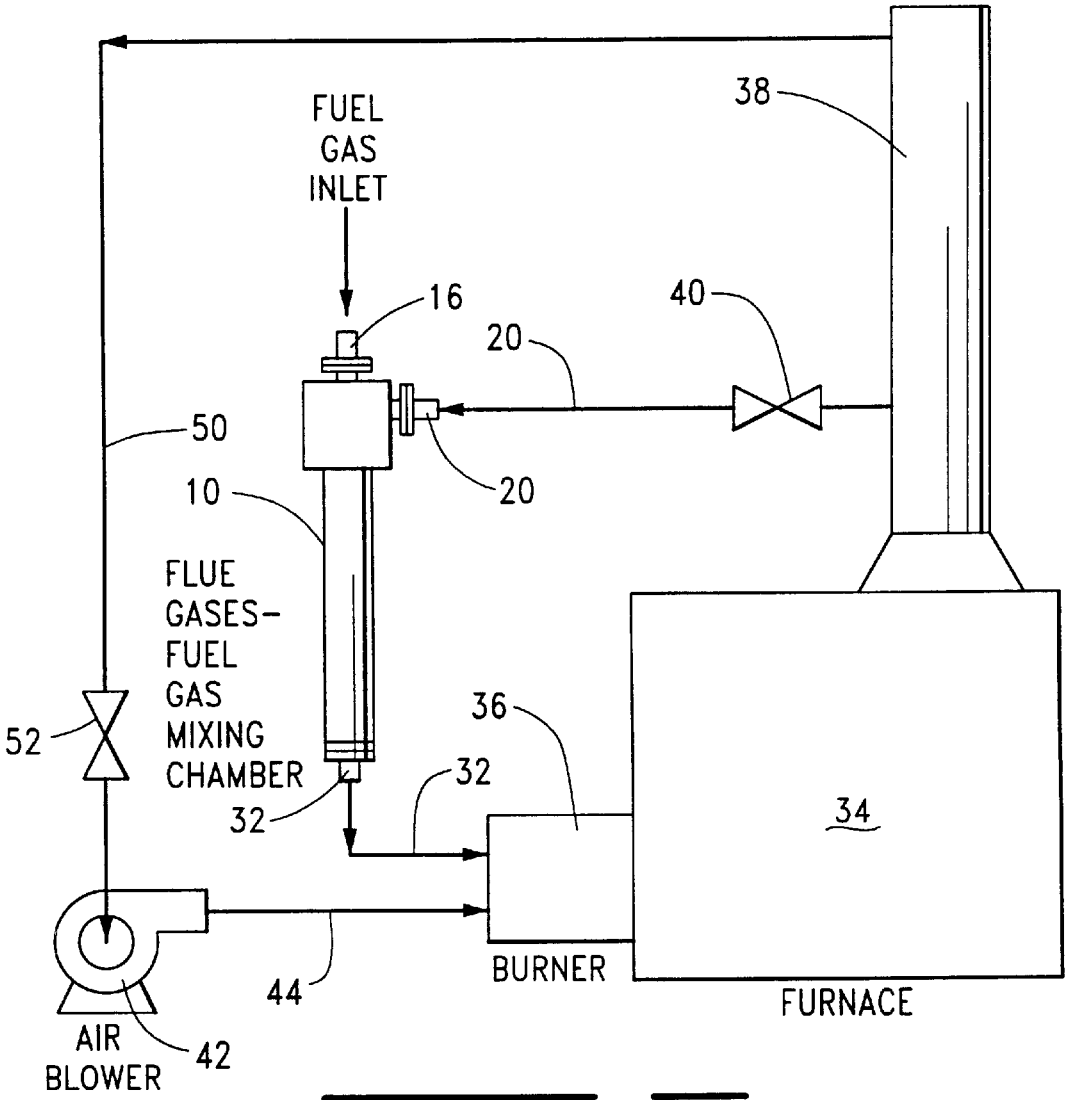
FIG. 5 is a schematic illustration which is the same as FIG. 3 except that a second flue gases conduit is connected between the furnace and the air blower.
Figure 5:
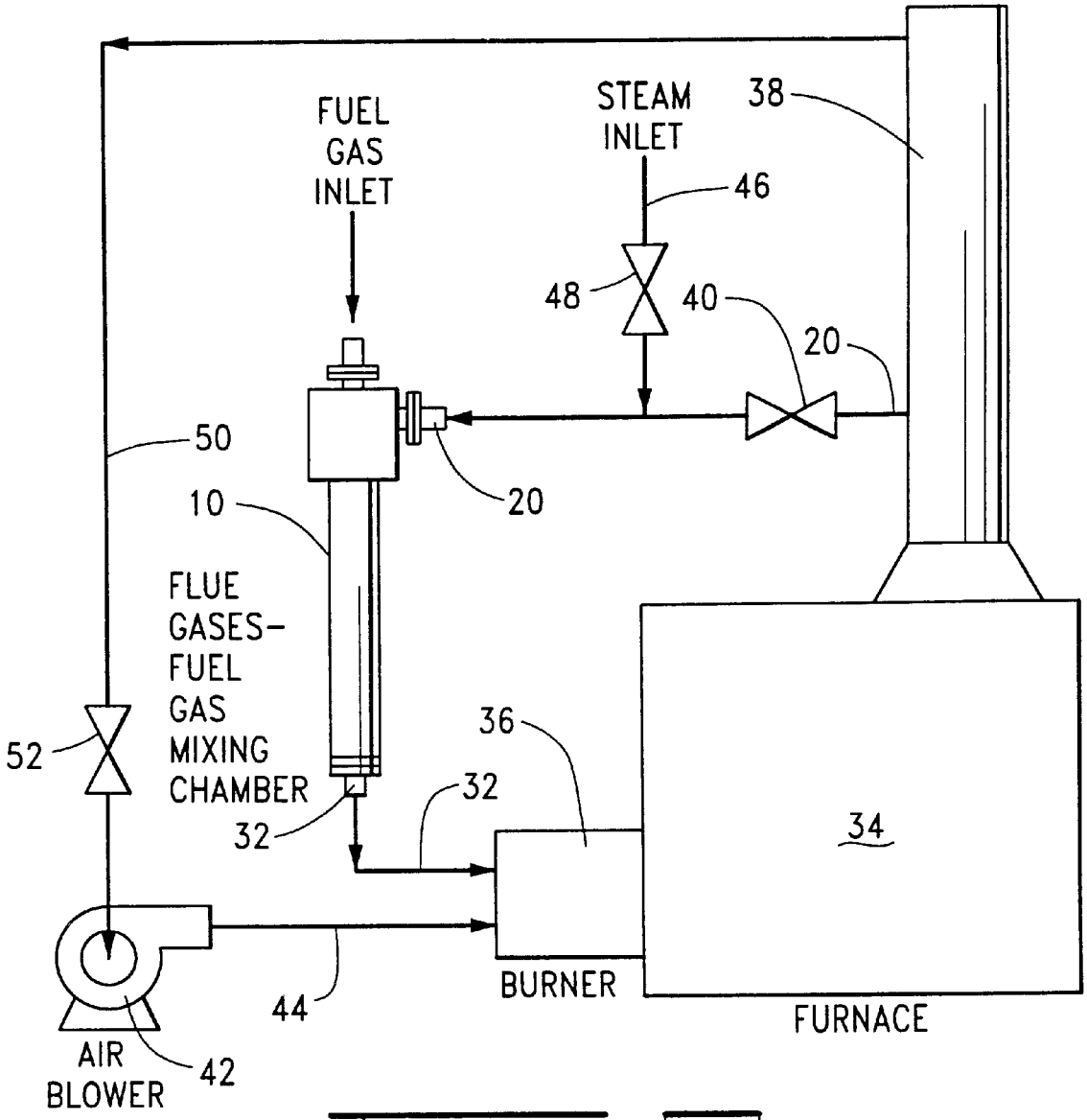

Referring now to FIG. 5, yet another alternate embodiment of the invention is shown. That is, the mixing chamber 10, the combustion air blower 42, the burner 36 and the furnace 34 as well as the connecting conduits 16, 20, 32 and 44 are the same as those illustrated in FIG. 3 and described above. In addition, a second flue gases conduit 50 is connected to the stack 38 of the furnace 34 and to an inlet connection in the combustion air blower 42 whereby additional flue gases are drawn from the stack 38 through the conduit 50 into the combustion air blower 42 wherein they mix with the combustion air. A flow control valve 52 is disposed in the conduit 50 for controlling the volume ratio of flue gases mixed with the combustion air.

The operation of the apparatus shown in FIG. 5 is the same as that described above in connection with the apparatus illustrated in FIG. 3 except that additional flue gases are introduced into the burner 36 in admixture with the combustion air. The presence of the additional flue gases in the combustion air functions to further cool the flame temperature in the furnace 34 and reduce the content of nitrogen oxide compounds in the flue gases discharged into the atmosphere from the stack 38.

Referring now to FIG. 6, yet another embodiment of the present invention is illustrated. The mixing chamber 10, the combustion air blower 42, the burner 36 and the furnace 34 as well as the conduits 16, 20, 32 and 44 are the same as those illustrated in FIG. 3 and described above. In addition, the apparatus illustrated in FIG. 6 includes the steam conduit 46 connected to the first flue gases conduit 20 and the flow control valve 48 disposed therein as illustrated in FIG. 4 as well as the second flue gases conduit 50 and the flow control valve 52 disposed therein illustrated in FIG. 5.

Thus, the apparatus of FIG. 6 mixes flue gases and steam with the fuel gas prior to conducting the resulting mixture to the burner 36, and flue gases are mixed with the combustion air in the combustion air blower 42 with the resulting mixture being introduced into the burner 36. By controlling the volumes of flue gases and steam mixed with the fuel gas and the volume of flue gases mixed with the combustion air, the content of nitrogen oxides in the flue gases discharged to the atmosphere are minimized.

As will be understood by those skilled in the art, the selection of one of the systems of apparatus illustrated in FIGS. 3–6 depends on a variety of factors including, but not limited to, the size of the furnace, the number of burners utilized with the furnace, the form and make-up of the fuel, the temperature reached within the interior of the furnace and the like. Based on such factors, the particular system of apparatus required to produce the desired low nitrogen oxides content in the flue gases discharged to the atmosphere is selected.

The methods of the present invention for reducing the content of nitrogen oxides in the flue gases produced by the combustion of an at least substantially stoichiometric mixture of fuel gas and combustion air introduced into a burner connected to a furnace are basically comprised of the following steps. Combustion air is conducted from a source thereof to the burner. A mixing chamber is provided outside of the burner and furnace for mixing flue gases from the furnace with the fuel gas. The fuel gas is discharged in the form a fuel jet into the mixing chamber so that flue gases from the furnace are drawn into the chamber and mix with and dilute the fuel gas therein. The mixture of flue gases and fuel gas formed in the mixing chamber is conducted therefrom to the burner wherein the mixture is combined with the combustion air and then burned therein and in the furnace. The above method preferably also includes the step of controlling the volume ratio of the flue gases mixed with the fuel gas. In addition, the method can include the additional steps of mixing steam with the flue gases prior to mixing the flue gases with the fuel gas in the mixing chamber, controlling the volume ratio of the steam mixed with the flue gases, mixing flue gases from the furnace with the combustion air conducted to the burner and controlling the volume ratio of the flue gases mixed with the combustion air.

The methods and apparatus of this invention have been shown to be significantly more efficient than prior art methods and apparatus. The recirculation of about 5% of the total flue gases in accordance with the invention as shown in FIG. 3 results in a lower nitrogen oxides content in the flue gases produced than a system wherein 23% of the total flue gases is combined with only the combustion air. Test results have indicated that a nitrogen oxides content in the flue gases of 20 parts per million or less is obtainable utilizing the methods and apparatus of this invention without steam injection, and without the concurrent use of flue gases recirculation in the combustion air. When steam injection into the flue gases is utilized in accordance with the present invention along with flue gases introduction into the combustion air, a flue gas nitrogen oxide content of from 8 to 14 parts per million can be achieved.

In order to further illustrate the improved results of the present invention, the following example is given.

EXAMPLE

The apparatus illustrated in FIG. 5 was tested to determine the nitrogen oxides content of the flue gases at various ratios of flue gases mixed with the fuel gas, various ratios of flue gases mixed with the combustion air and a combination of the two. The furnace utilized in the test was a 63.5 million BTU steam generator. The results of these tests are given in the Table below.

TABLE

Flue Gases $NO_2$ Content Using Various Amounts Of Flue Gases Mixed With Fuel Gas And/Or Combustion Air

| Test No. | Setting of Flue Gases Valve 40[1], percent open | Setting of Flue Gases Valve 52[2], percent open | $NO_x$ Content of Flue Gases Discharged to Atmosphere |
|---|---|---|---|
| 1 | 0% | 50% | 26 ppm |
| 2 | 50% | 0% | 23 ppm |
| 3 | 75% | 0% | 20 ppm |
| 4 | 50% | 35% | 18 ppm |
| 5 | 75% | 50% | 14 |

[1]Flue gases mixed with fuel gas.
[2]Flue gases mixed with combustion air.

From the above Table, it can be seen that the methods and apparatus of the present invention produce flue gases having unexpected reduced nitrogen oxides content.

Thus, the present invention is well adapted to carry out the objects and attain the ends and advantages mentioned as well as those which are inherent therein. While numerous changes may be made by those skilled in the art, such changes are encompassed within the spirit of this invention as defined by the appended claims.

What is claimed is:

1. A method of reducing the content of nitrogen oxides in flue gases produced by the combustion of an at least substantially stoichiometric mixture of fuel gas and combustion air introduced into a burner connected to a furnace comprising the steps of:

(a) conducting said combustion air to said burner;

(b) providing a chamber outside of said burner and furnace for mixing flue gases from said furnace with said fuel gas, said chamber including a fuel gas jet-forming nozzle and a venturi and mixing compartment therein;

(c) discharging said fuel gas in the form of a fuel gas jet into said mixing chamber by way of said fuel gas jet-forming nozzle so that flue gases from said furnace are drawn into said chamber and mix with and dilute said fuel gas in said venturi and mixing compartment therein; and (d) conducting the mixture of flue gases and fuel gas formed in step (c) to said burner wherein said mixture is combined with said combustion air and burned therein and in said furnace.

2. The method of claim 1 which further comprises the step of controlling the volume ratio of said flue gases mixed with said fuel gas in step (c).

3. The method of claim 1 which further comprises the step of mixing steam with said flue gases prior to mixing said flue gases with said fuel gas in accordance with step (c).

4. The method of claim 3 which further comprises the step of controlling the volume ratio of said steam mixed with said flue gases.

5. The method of claim 1 which further comprises the step of mixing flue gases from said furnace with said combustion air conducted to said burner in accordance with step (a).

6. The method of claim 5 which further comprises controlling the volume ratio of said flue gases mixed with said combustion air.

7. A method of reducing the content of nitrogen oxides in flue gases produced by the combustion of an at least substantially stoichiometric mixture of fuel gas and combustion air introduced into a burner connected to a furnace comprising the steps of:

(a) conducting said combustion air to said burner;

(b) providing a chamber outside of said burner and furnace for mixing flue gases from said furnace with said fuel gas, said chamber including a fuel gas jet-forming nozzle and a venturi and mixing compartment therein;

(c) discharging said fuel gas in the form of a fuel gas jet into said mixing chamber by way of said fuel gas jet-forming nozzle so that flue gases from said furnace are drawn into said chamber and mix with and dilute said fuel gas in said venturi and mixing compartment therein;

(d) controlling the volume ratio of said flue gases mixed with said fuel gas in step (c); and (e) conducting the mixture of flue gases and fuel gas formed in step (c) to said burner wherein said mixture is combined with said combustion air and burned therein and in said furnace.

8. The method of claim 7 which further comprises the step of mixing steam with said flue gases prior to mixing said flue gases with said fuel gas in accordance with step (c).

9. The method of claim 8 which further comprises the step of controlling the volume ratio of said steam mixed with said flue gases.

10. The method of claim 7 which further comprises the step of mixing flue gases from said furnace with said combustion air conducted to said burner in accordance with step (a).

11. The method of claim 10 which further comprises controlling the volume ratio of said flue gases mixed with said combustion air.

12. An apparatus for reducing the content of nitrogen oxides in flue gases produced by the combustion of an at least substantially stoichiometric mixture of fuel gas and combustion air, said fuel gas being conducted to a burner connected to a furnace by a fuel gas conduit and the combustion air being conducted from a source of combustion air to the burner by a combustion air conduit, comprising:

a chamber for mixing flue gases from said furnace with said fuel gas having a fuel gas inlet for connection to said fuel gas conduit, a fuel gas jet-forming nozzle for forming a fuel gas jet within said chamber, a flue gases inlet positioned so that flue gases are drawn into said chamber by said fuel gas jet, a venturi and mixing compartment therein for mixing said flue gases and fuel gas and a flue gases-fuel gas mixture outlet;

a first flue gases conduit for connection to said furnace connected to said flue gases inlet of said chamber; and a flue gases-fuel gas mixture conduit for connection to said burner connected to said flue gases-fuel gas mixture outlet of said chamber.

13. The apparatus of claim 12 which further comprises means for controlling the volume ratio of said flue gases mixed with said fuel gas in said chamber disposed in said first flue gases conduit.

14. The apparatus of claim 13 wherein said means for controlling the volume ratio of said flue gases to said fuel gas is comprised of a flow control valve.

15. The apparatus of claim 12 which further comprises a steam conduit for connection to a source of steam connected to said first flue gases conduit for mixing steam with said flue gases.

16. The apparatus of claim 15 which further comprises means for controlling the volume ratio of said steam mixed with said flue gases disposed in said steam conduit.

17. The apparatus of claim 16 wherein said means for controlling the volume ratio of said steam mixed with said flue gases comprises a flow control valve.

18. The apparatus of claim 12 wherein said source of combustion air is a combustion air blower.

19. The apparatus of claim 18 which further comprises a second flue gases conduit for connection to said furnace and to said combustion air blower so that flue gases are mixed with said combustion air.

20. The apparatus of claim 19 which further comprises means for controlling the volume ratio of said flue gases mixed with said combustion air disposed in said second flue gases conduit.

21. The apparatus of claim 20 wherein said means for controlling the volume ratio of said flue gases mixed with said combustion air comprises a flow control valve.

* * * * *